US008567527B2

(12) United States Patent
Jeffryes

(10) Patent No.: US 8,567,527 B2
(45) Date of Patent: Oct. 29, 2013

(54) SYSTEM AND METHOD FOR DRILLING A BOREHOLE

(75) Inventor: Benjamin P. Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 163 days.

(21) Appl. No.: 13/344,535

(22) Filed: Jan. 5, 2012

(65) Prior Publication Data

US 2012/0103693 A1 May 3, 2012

Related U.S. Application Data

(62) Division of application No. 11/667,231, filed as application No. PCT/GB2005/004424 on Nov. 16, 2005, now Pat. No. 8,109,345.

(51) Int. Cl.
*E21B 7/04* (2006.01)

(52) U.S. Cl.
USPC ..... 175/61; 175/73; 175/16; 166/245; 166/117.5

(58) Field of Classification Search
USPC ..... 175/16, 26, 61, 424, 73; 166/245, 248, 166/255.3, 117.5
See application file for complete search history.

(56) References Cited

U.S. PATENT DOCUMENTS 7,147,064 B2 * 12/2006 Batarseh et al. ..... 175/11

* cited by examiner

*Primary Examiner* — Yong-Suk (Philip) Ro

(57) ABSTRACT

A system and method is provided for drilling a wellbore using a rotary drill bit with a bit body having a plurality of mechanical cutters to cut away formation material as the wellbore is formed; and a directed energy mechanism to direct energy into the formation. The energy from the directed energy mechanism is used to enhance the cutting of the mechanical cutters by fracturing surrounding material to facilitate drilling in the direction of the directed energy.

19 Claims, 4 Drawing Sheets

SYSTEM AND METHOD FOR DRILLING A BOREHOLE

CROSS-REFERENCE TO RELATED APPLICATION

This is a divisional application of co-pending U.S. patent application Ser. No. 11/667,231 filed Nov. 19, 2007, which is a National Stage Entry of PCT Application Serial No. PCT/GB2005/004424 filed Nov. 16, 2005, which claims priority to British Application Serial No. GB 0425312.6 filed Nov. 17, 2004; all of which are incorporated herein by reference in their entirety.

BACKGROUND

In a variety of subterranean environments, desirable production fluids exist. The fluids can be accessed and produced by drilling boreholes, i.e., wellbores, into the subterranean formation holding such fluids. For example, in the production of oil, one or more wellbores are drilled into or through an oil holding formation. The oil flows into the wellbore from which it is produced to a desired collection location. Wellbores can be used for a variety of related procedures, such as injection procedures. Sometimes wellbores are drilled generally vertically, but other applications utilize lateral or deviated wellbores.

Wellbores generally are drilled with a drill bit having a cutter rotated against the formation material to cut the borehole. Deviated sections of wellbore can be formed by "pushing the bit" in which the bit is pushed against a borehole wall as it is rotated to change the direction of drilling. In other applications, the deviated wellbore can be formed by "pointing the bit" in a desired direction and employing weight on the bit too move it in the desired direction. Another alternative is to use an asymmetric bit and pulse weight applied to the bit so that it tends to drill in a desired direction. However, each of these techniques presents problems in various applications. For example, problems can arise when the borehole size is over-gauge or the borehole rock is too soft. Other problems can occur when trying to drill at a relatively high angle through hard layers. In this latter environment, the drill bit often tends to follow softer rock and does not adequately penetrate the harder layers of rock.

In the international patent application WO 2005/054620, filed before, but published after the original filing date of this invention, there are described various electro-pulse drill bits including examples where the removal of cuttings are supported by mechanical cutters or scrapers and examples of non-rotary examples where the electro-pulses are given a desired direction.

SUMMARY

In general, the present invention provides a system and method for drilling wellbores in a variety of environments. A drill bit assembly incorporates a directed energy system to facilitate cutting of boreholes. Although the overall system and method can be used in many types of environments for forming various wellbores, the system is particularly useful as a steerable assembly used to form deviated wellbores.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to the drilling of wellbores. A drilling assembly is used to form generally vertical and/or deviated wellbores. A directed energy mechanism is utilized to fracture, spall or weaken formation material as the drilling assembly moves through a subterranean environment. The directed energy mechanism facilitates the drilling process and also can be used in a steerable drilling assembly to aid in steering the assembly to drill, for example, deviated wellbores. However, the devices and methods of the present invention are not limited to use in the specific applications that are described herein.

Figure 1:
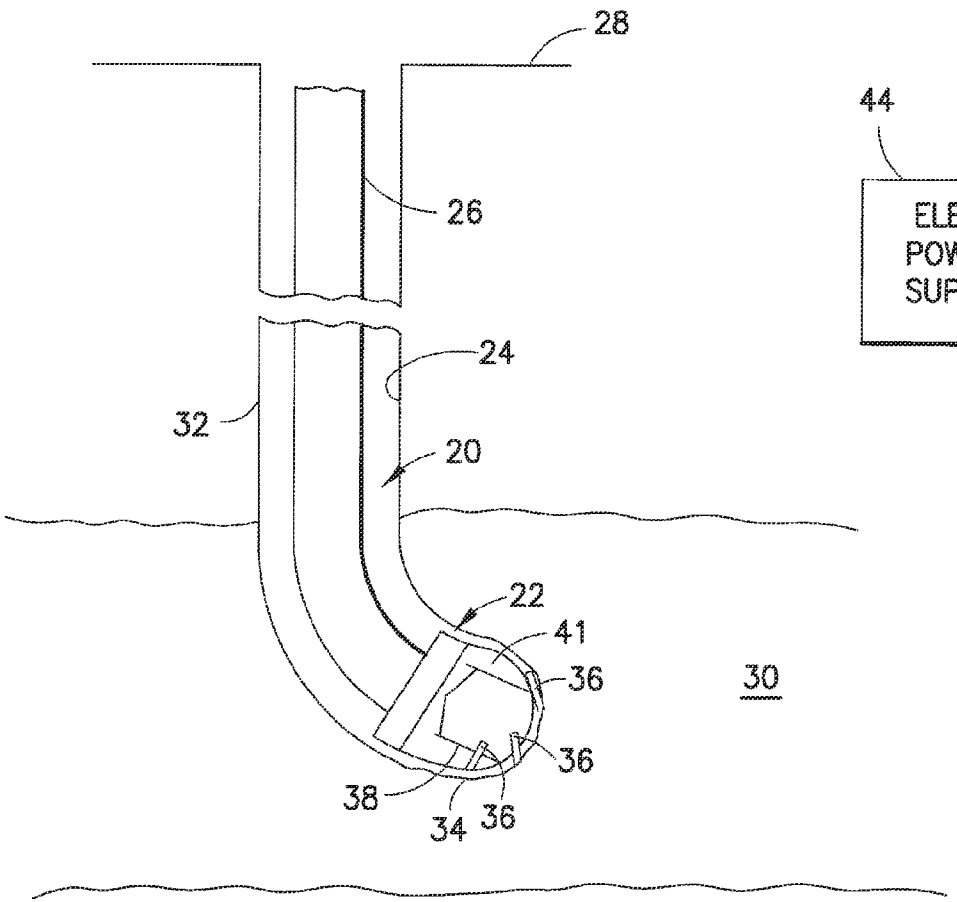
FIG. 1 is a front elevation view of a drilling assembly forming a wellbore, according to an embodiment of the present invention.

Referring generally to FIG. 1, a system 20 is illustrated according to an embodiment of the present invention. In the particular embodiment illustrated, system 20 comprises a drilling assembly 22 used to form a borehole 24, e.g., a wellbore. Drilling assembly 22 is moved into the subterranean environment via an appropriate drill string 26 or other deployment system. Often, the wellbore 24 is drilled from a surface 28 of the earth downwardly into a desired formation 30. In the embodiment illustrated, the wellbore 24 has a generally vertical section 32 that transitions towards a deviated section 34 as drilling assembly 22 is steered to form the lateral wellbore.

In this example, drilling assembly 22 is a rotary, steerable drilling assembly having one or more fixed cutters 36 that are rotated against formation 30 to cut away formation material as the wellbore is formed. Drilling assembly 22 also comprises a directed energy mechanism 38 utilized to crack, break or weaken formation material proximate drilling assembly 22 as wellbore 24 is formed. The directed energy mechanism 38 directs energy, such as electromagnetic energy, against the formation to fracture or otherwise damage formation material. This non-cutting technique supplements the action of cutters 36 to facilitate formation of wellbore 24. Additionally, the non-cutting energy can be directed at specific regions of formation 30 to enable the steering of drilling assembly 22 even through hard or otherwise difficult to cut formation materials.

Figure 2:
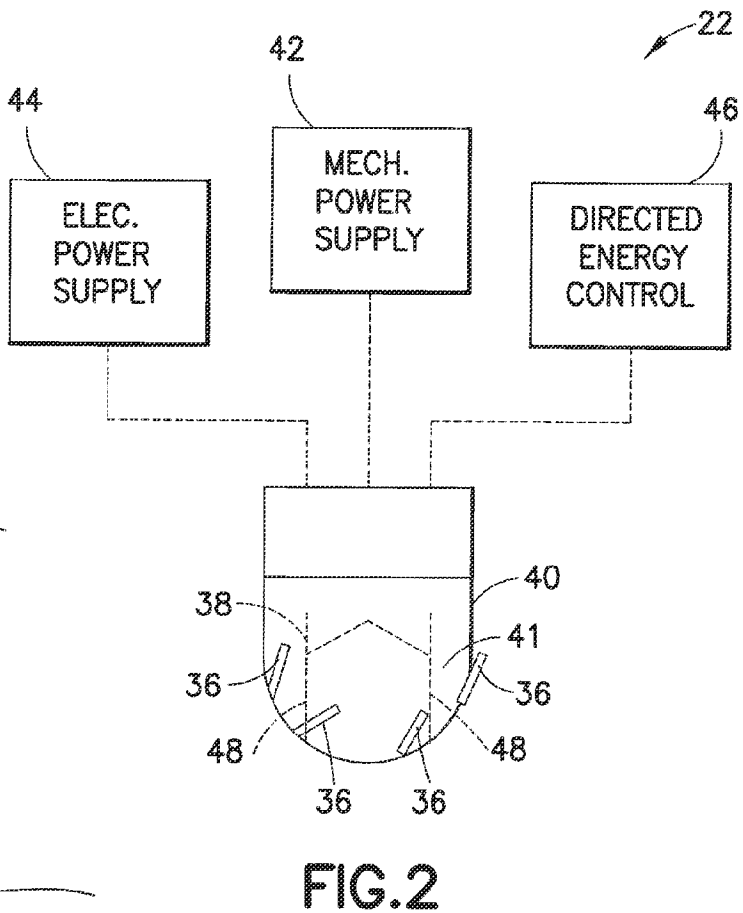
FIG. 2 is a schematic illustration of an embodiment of a drilling assembly that may be used with the system illustrated in FIG. 1.

Referring to FIG. 2, a schematic illustration is provided to show elements of one embodiment of drilling assembly 22. In this embodiment, drilling assembly 22 utilizes a drill bit 40 having a bit body 41 and one or more of the mechanical cutters 36 for cutting formation material. Mechanical cutters 36 are mounted on bit body 41. Drill bit 40 is rotated by a mechanical power source 42, such as an electric motor which may rotate the drillstring 26 either at the surface or downhole, and may also be rotated by a downhole electric motor or other means such as a hydraulic motor, examples of which are positive displacement motors and turbines. Additionally, electrical power is supplied by an electric power supply 44. The electrical power can be used to power directed energy mechanism 38 for providing a controlled fracturing of formation material proximate drill bit 40. Additionally, a directed energy controller 46 can be used to control the application of directed energy to the surrounding formation material.

The use of directed energy in conjunction with the mechanical bit enhances the cutting of formation materials, particularly materials such as hard rock. The directed energy can be delivered to formation 30 by, for example, directed energy members 48 that are distributed around the circumference of drill bit 40. As discussed more fully below, such directed energy members 48 can be used for side-cutting, i.e. causing drilling assembly 22 to turn in a desired direction by supplying energy to members on the side of the bit that coincides with the desired change in direction. If the rate of turn becomes excessive, the energy selectively sent to specific elements 48 can be interrupted for a proportion of the time, or more energy can be distributed to other sides of the drill bit to increase rock removal in other locations about drill bit 40. An example of directed energy is electromagnetic energy that may be supplied in a variety of forms.

Figure 5:
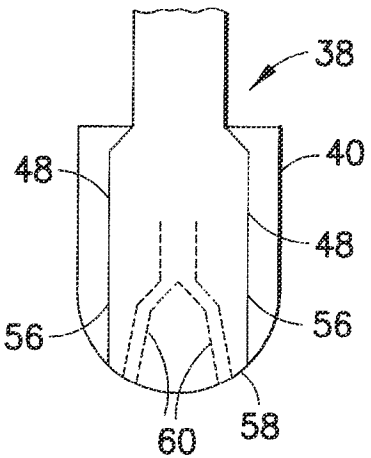
FIG. 5 is a schematic illustration of another alternate embodiment of a drill bit incorporating a directed energy mechanism that may be used with the system illustrated in FIG. 1.
Figure 4:
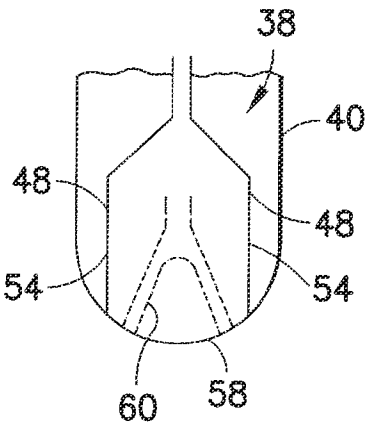
FIG. 4 is a schematic illustration of an alternate embodiment of a drill bit incorporating a directed energy mechanism that may be used with the system illustrated in FIG. 1.
Figure 3:
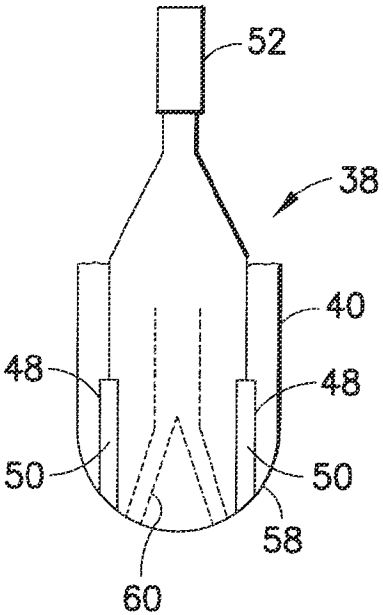
FIG. 3 is a schematic illustration of an embodiment of a drill bit incorporating a directed energy mechanism that may be used with the system illustrated in FIG. 1.

Examples of drill bits 40 combined with directed energy mechanisms 38 are further illustrated in FIGS. 3-5. The figures illustrate several embodiments able to utilize electromagnetic energy in fracturing subterranean materials to form boreholes. In FIG. 3, for example, directed energy members comprise a plurality of waveguides 50, such as fiber optics or gas/fluid filled members. In this embodiment, electrical power provided by electric power supply 44 is pulsed and converted by a laser 52 into pulsed optical power. The laser energy is directed at the formation material surrounding drill bit 40 via waveguides 50. The laser energy heats the rock and any fluid contained within the rock to a level that breaks the rock either through thermally induced cracking, pore fluid expansion or material melting. The target or formation material at which the laser energy is directed can be controlled by directed energy control 46. For example, a switching system can be used to direct the pulsed optical power to specific waveguides 50 when they are disposed along one side of drill bit 40. This, of course, facilitates directional turning of the drill bit to create, for example, a lateral wellbore.

In another embodiment, illustrated in FIG. 4, directed energy members 48 comprise a plurality of electrodes 54. Electrodes 54 can be utilized in delivering electromagnetic energy against the material surrounding drill bit 40 to break down the materials and enhance the wellbore forming capability of the drilling assembly. In this particular embodiment, electrodes 54 are used for electrohydraulic drilling in which drill bit 40 and directed energy mechanism 38 are submerged in fluid. Selected electrodes 54 are separated from a ground conductor and raised to a high-voltage until the voltage is discharged through the fluid. This produces a local fluid expansion and, hence, a pressure pulse. By applying the pressure pulse close to the formation material surrounding drill bit 40, the material is cracked or broken into pieces. This destruction of material can be enhanced by utilizing a phased electrode array. Again, by supplying the electrical power to selected electrodes 54, the breakdown of surrounding material can be focused along one side of drill bit 40, thereby enhancing the ability to steer the drilling assembly 22 in that particular direction.

Another embodiment of directed energy mechanism 38 is illustrated in FIG. 5. In this embodiment, electric energy is provided by electric power supply 44 and controlled by directed energy control 46 to provide electrical pulses to electrodes 56. The electric pulses enable electric pulsed drilling in which electrical potential is discharged through surrounding rock, as opposed to through surrounding fluid as with electrohydraulic drilling. As voltage is discharged through rock close to electrodes 56, the rock or other material is fractured to facilitate formation of the borehole 24. As with the other embodiments described above, electrical power can be selectively supplied to electrodes 56 along one side of drill bit 40 to enhance the steerability of drilling assembly 22.

In the embodiments discussed above, the directed energy members 48 rotate with drill bit 40. Thus, there is no need for components to remain mechanically stationary with respect to the surrounding formation. However, other designs and applications can utilize stationary components, such as a stationary directed energy mechanism.

Additionally, directed energy members 48 may be arranged in a variety of patterns and locations. As illustrated, each of the directed energy members 48 may be positioned to extend to a bit face 58 of drill bit 40. This facilitates transfer of directed energy to the closely surrounding formation material, thus enhancing breakdown of the proximate formation material.

Drill bit 40 may be constructed in a variety of forms with various arrangements of mechanical cutters 36 connected to bit body 41. For example, mechanical cutters 36 may be fixed to bit body 41 and/or the drill bit can be formed as a bi-center bit. Additionally, passages 60 can be formed through drill bit 44 to conduct drilling fluid therethrough. Passages 60 can be formed directly in bit body 41, or they can be incorporated into a replaceable nozzle to conduct drilling fluid through bit face 58. The drilling fluid conducted through passages 60 aids in washing cuttings away from drill bit 40. It should be noted that these are just a few examples of the many potential variations of drill bit 40, and that other types of drill bits can be utilized with directed energy mechanism 38.

Figure 6:
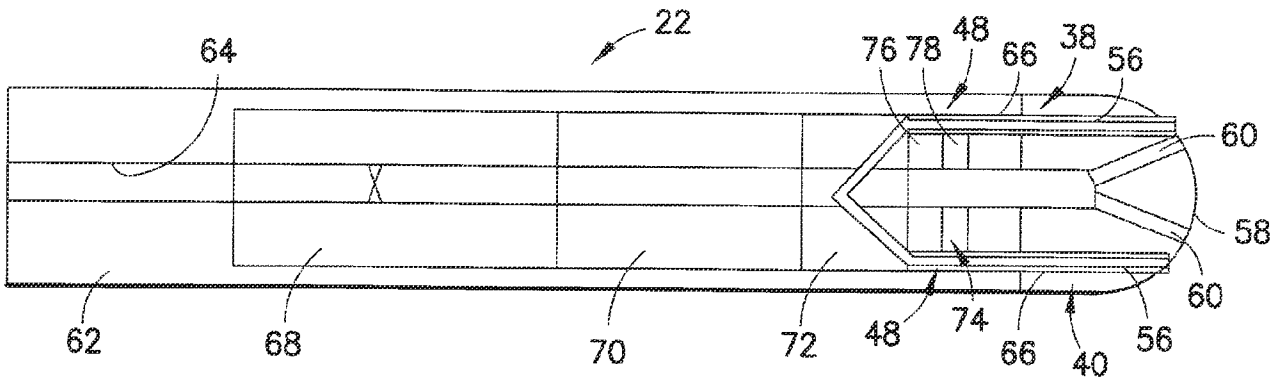
FIG. 6 is an elevation view of a drilling assembly disposed in a lateral wellbore, according to an embodiment of the present invention.

Referring to FIG. 6, a detailed example of one type of drilling assembly 22 is illustrated in which the drilling assembly comprises a rotary steerable drilling assembly. In this embodiment, drilling assembly 22 comprises drill collars 62 through which extends a flow passage 64 for delivering drilling fluid to outlet passages 60 that extend through bit face 58. In the embodiment illustrated, flow passage 64 lies generally along the centerline of collars 62, and other components surround the flow passage. However, in an alternate embodiment, components can lie along the centerline, and the drilling fluid can be routed through an annular passage.

As illustrated, directed energy mechanism 38 comprises directed energy members 48 in the form of electrodes 56 surrounded by an insulation material 66. Electric power is generated by, for example, a turbine 68 positioned as part of the steerable drilling assembly 22. However, the power generating turbine 68 also can be located remotely with respect to drilling assembly 22. Electric power generated by turbine 68 is used to charge a repetitive pulsed power unit 70. In this embodiment, pulsed power unit 70 is disposed between turbine 68 and drill bit 40. However, the components can be arranged in other locations. One example of a repetitive pulsed power unit 70 is a Marx generator.

The pulses output by pulsed power unit 70 may be compressed by a magnetic pulse compressor 72. In some applications, for example, the output from pulsed power unit 70 may not have a fast enough rise time for electric pulsed drilling. In such applications, the magnetic pulse compressor 72 may be used to compress the pulses. Between discharges through electrodes 56, the individual pulses can be switched between different electrodes 56. As discussed above, the utilization of specific electrodes disposed, for example, along one side of drill bit 40 substantially facilitates the steerability of drilling assembly 22.

A greater degree of control over the turning of drilling assembly 22 can be achieved with the aid of directed energy control 46 which, in this embodiment, comprises a directional sensor unit 74. Sensor unit 74 comprises, for example, accelerometers 76 and magnetometers 78 to determine through which electrode the pulse should be discharged to maintain or change the direction of drilling. In this example, electrodes 56 are arranged in a symmetric pattern around the lead face of drill bit 40. However, other arrangements of directed energy members 48 may be selected for other applications. Also, directed energy mechanism 38 is used in cooperation with mechanical cutters 36 to more efficiently form cuttings and provide greater steerability of the drilling assembly 22.

Figure 7:
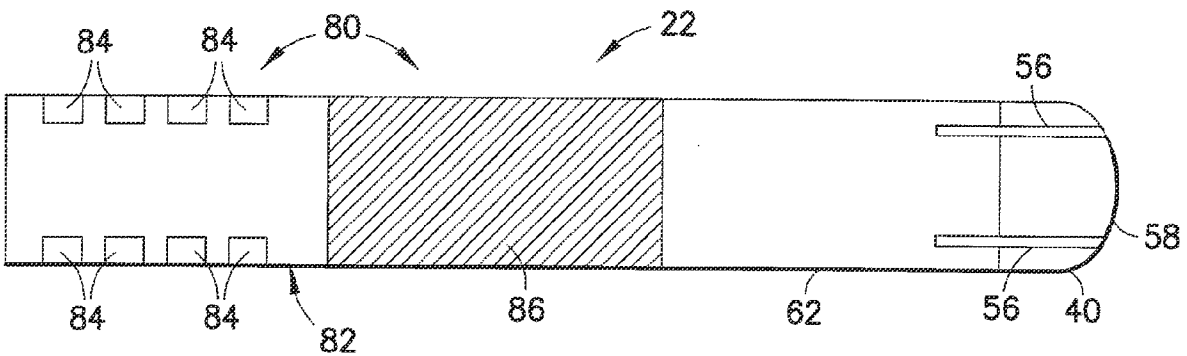
FIG. 7 is a front elevation view of another embodiment of a drilling assembly, according to an embodiment of the present invention.

Another embodiment of drilling assembly 22 is illustrated in FIG. 7. In this embodiment, drilling assembly 22 comprises an acoustic imaging system 80 for downhole formation imaging during drilling. Acoustic imaging system 80 comprises, for example, an acoustic receiver section 82 having an acoustic receiver and typically a plurality of acoustic receivers 84. By way of example, acoustic receivers 84 may comprise piezoelectric transducers. Acoustic receiver section 82 may be formed as a collar coupled to a damping section 86. Damping section 86 may be formed of a metal material able to provide damping of the acoustic waves transmitted therethrough to acoustic receivers 84. In other words, electrodes, such as electrodes 56, provide an acoustic source during the electric discharges used to break down formation material. Acoustic receivers 84 are used to sense the acoustic waves transmitted through and reflected from the different materials comprising the rock formation, providing the means to image the formation downhole while drilling.

Figure 8:
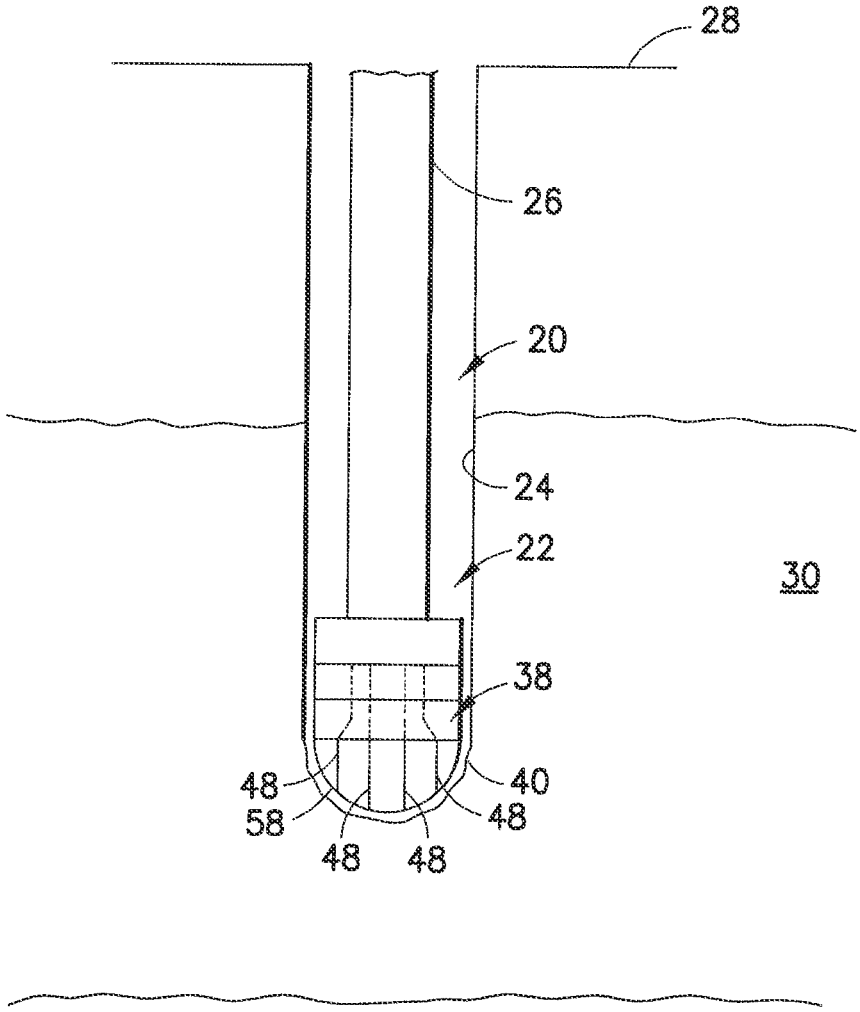
FIG. 8 is a front elevation view of another embodiment of a drilling assembly disposed in a well, according to an embodiment of the present invention.

It should be noted that the directed energy mechanism 38 can be used in a variety of drilling assemblies and applications. For example, although the use non-cutting directed energy substantially aids in the steerability of a given drilling assembly, the use of directed energy mechanism 38 also facilitates linear drilling. As illustrated in FIG. 8, directed energy mechanism 38 can be used with a variety of drill bits 40, including drill bits without mechanical cutters. Sufficient directed energy can sufficiently destruct formation materials without mechanical cutting. The resultant cuttings can be washed away with drilling fluid as in conventional systems. Additionally, the size, number and arrangement of directed energy members 48 can be changed according to the design of drilling assembly 22, the size of wellbore 24, the materials found information 30 and other factors affecting the formation of the borehole.

Furthermore, drilling assembly 22 is amenable to use with other or additional components and other styles of drill bits. For example, the directed energy mechanism 38 can be combined with drilling systems having a variety of configurations. Additionally, the directed energy mechanism can be combined with alternate steering assemblies, including "pointing the bit" and "pushing the bit" type steering assemblies.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

The invention claimed is:

1. A method for directional drilling through an Earth formation, comprising:

drilling a borehole through the Earth formation with a rotary drill bit, the rotary drill bit comprising a plurality of mechanical cutters configured to cut into the Earth formation;

changing the direction of drilling by applying a non-cutting directed energy from a non-cutting directed energy source to a region of the formation proximate to a selected side of the drill bit, wherein the region of the formation is off-center from a center line of the drill bit and the selected side of the drill bit coincides with a desired drilling direction, and wherein non-cutting directed energy is repeatedly applied to the region to steer the rotary drill bit in the desired direction;

determining a direction of drilling of the drill bit; and controlling an application of the non-cutting directed energy to the region of the formation to provide for directing the drill bit in a desired drilling direction, wherein controlling the application of the non-cutting directed energy comprises applying the non-cutting directed energy to the region to increase turn of the drill bit in the direction of the region and interrupting application of the non-cutting directed energy to the region to reduce turn in of the drill bit in the direction of the region.

2. The method as recited in claim 1, wherein the region of the formation is disposed proximate to a circumference of the drill bit to provide for sideways cutting.

3. The method as recited in claim 1, wherein the non-cutting directed energy is directed to different positions proximate to a circumference of the drill bit to provide for side cutting in any of the different positions.

4. The method as recited in claim 1, wherein the non-cutting directed energy is applied to the formation through one or more directed energy mechanisms.

5. The method as recited in claim 1, wherein the directed energy mechanisms are held stationary relative to rotation of the drill bit.

6. A drilling system for drilling a borehole through an Earth formation, comprising:

a drill bit comprising a plurality of mechanical cutters and configured to be rotated against the formation to provide for cutting of the formation by the mechanical cutters;

an electromagnetic directed energy mechanism configured to provide for directional steering by the drilling system by delivering electromagnetic energy to regions of the formation that are disposed proximal to a circumference of the drill bit; and a switching system configured in use to direct the electromagnetic energy to one or more of the regions that are disposed along one side of drill bit to produce directional drilling by the drill bit in a direction of the one or more of the regions.

7. The system as recited in claim 6, further comprising:

one or more directed energy members configured to direct the electromagnetic energy through the drill bit to the regions of the formation.

8. The system as recited in claim 7, wherein the one or more electromagnetic directed energy members are disposed at a circumference of the drill bit.

9. The system as recited in claim 7, further comprising:

a directional sensor configured to sense a direction of the drill bit.

10. The system as recited in claim 9, wherein the directional sensor comprises a magnetometer.

11. The system as recited in claim 9, wherein the directional sensor comprises an accelerometer.

12. The system as recited in claim 7, further comprising:

a controller configured to control the electromagnetic directed energy mechanism to direct electromagnetic energy to the one or more regions of the formation to change the direction of the drill bit.

13. The system as recited in claim 7, wherein the one or more directed energy members comprise electrodes to deliver electromagnetic energy to the formation.

14. The system as recited in claim 7, wherein the one or more directed energy members comprise an optical element to direct laser energy through the drill bit to the formation.

15. The system as recited in claim 6, wherein the drilling system comprises a plurality of electrodes and a directional controller to control delivery of electromagnetic energy to specific electrodes.

16. The system as recited in claim 15, wherein the drilling system further comprises:

an acoustic receiver for detecting acoustic waves resulting from electromagnetic energy delivered through the electrodes.

17. The system as recited in claim 16, wherein the acoustic receiver comprises a plurality of piezoelectric transducers.

18. The system as recited in claim 15, wherein the plurality of electrodes terminate generally flush with a bit face of the drill bit.

19. The system as recited in claim 15, wherein the plurality of electrodes rotate with the drill bit.

* * * * *